US007383008B2

(12) United States Patent
Aruga

(10) Patent No.: US 7,383,008 B2
(45) Date of Patent: Jun. 3, 2008

(54) FIXING RUBBER ROLLER, FIXING DEVICE AND IMAGE FORMING APPARATUS INCORPORATING THE SAME

(75) Inventor: Tomoe Aruga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 617 days.

(21) Appl. No.: 10/764,487

(22) Filed: Jan. 27, 2004

(65) Prior Publication Data

US 2004/0265020 A1 Dec. 30, 2004

(30) Foreign Application Priority Data

Jan. 28, 2003 (JP) ..... P2003-018292
Jan. 30, 2003 (JP) ..... P2003-021700
Jan. 30, 2003 (JP) ..... P2003-021701
Feb. 13, 2003 (JP) ..... P2003-034897

(51) Int. Cl.
*G03G 15/20* (2006.01)

(52) U.S. Cl. ..... 399/328

(58) Field of Classification Search ..... 399/320, 399/328, 329, 330, 331
See application file for complete search history.

(56) References Cited

U.S. PATENT DOCUMENTS 3,324,791 A 6/1967 Cassano et al.
5,546,173 A * 8/1996 Hinotani et al. ..... 399/331
6,556,798 B2 * 4/2003 Rimai et al. ..... 399/328 X
6,795,678 B2 * 9/2004 Yura et al. ..... 399/329

FOREIGN PATENT DOCUMENTS

JP 42-14119 8/1942
JP 1-20745 B2 4/1989

* cited by examiner

*Primary Examiner*—Sandra L Brase
(74) *Attorney, Agent, or Firm*—Sughrue Mion, PLLC

(57) ABSTRACT

There is disclosed a device for fixing a toner image on a recording medium. A heat source is incorporated in a first roller. A heat-resistant belt member is stretched by a second roller and a stretcher and circulated therearound. The belt member is brought into contact with the first roller to form a nip portion therebetween through which the recording medium is passed. At least one of the first roller and the second roller is provided with a cylindrical core member and a rubber layer. The cylindrical core member is formed with a first portion having a first diameter, a second portion having a second diameter which is smaller than the first diameter, and a step portion continuously connecting the first portion and the second portion. The rubber layer is secured to an outer periphery of the core member so as to cover at least the first portion and a part of the step portion.

8 Claims, 14 Drawing Sheets

FIXING RUBBER ROLLER, FIXING DEVICE AND IMAGE FORMING APPARATUS INCORPORATING THE SAME

BACKGROUND OF THE INVENTION

The present invention relates to image forming apparatuses such as copiers, printers, and facsimile machines and, more particularly, to a fixing rubber roller and a fixing device incorporated in such image forming apparatuses.

In a fixing device, normally, at least either a heating roller and a pressure roller is an elastic member or a rubber roller. The pressure roller is pressed against the heating roller with a predetermined pressure to form a nip. A transfer material having unfixed toner image is passed between the heating roller and the pressure roller to heat and fix the toner image. In general, the rubber roller is provided by heat-curing rubber on a circumferential surface of a rigid body or metal core roller to a predetermined thickness to mold the rubber and bond it to the core roller simultaneously.

However, since the rubber roller rotates while it is pressed against an opposite roller, both end faces of the rubber roller are bulgingly deformed by the pressure, and a problem arises, after use for a long time period, in that the end faces and the rubber layer comes off the circumferential surface of the core roller at the end faces and in the vicinity of the same.

In order to solve this problem, according to Japanese Patent Publication No. 1-20745B, both longitudinal ends of a rubber layer of a rubber roller is chamfered over a predetermined length. When the rubber roller is rotated while it is pressed against a roller provided opposite thereto, the chamfered portions are not in contact with the opposite roller or subjected to a contact pressure that is very small compared to a contact pressure applied to a region of the roller located inside the chamfered portions in the longitudinal direction of the roller. This reduces a pressure acting on end face portions of the rubber layer which can bulgingly deform the layer and prevents the problem that the rubber layer comes off the circumferential surface of the rigid core roller at the end face portions and in the vicinity of the same.

However, there is a problem in that the method involves a complicated processing step for forming the rubber layer on the circumferential surface of the rigid core roller using press cure, cutting the layer into a predetermined length, and processing the layer into a chamfered shape over a predetermined length from the longitudinal ends of the layer. In addition, there is another problem in that it is costly to stay with the processing of the rubber layer that is an elastic member because the process is difficult to perform and is not preferable in processing accuracy.

Japanese Patent Publication No. 42-14119B discloses a fixing device comprising a heating roller incorporating a heat source and a pressure roller which is pressed against the heating roller to form a fixing nip portion. The pressure roller is provided by forming a rubber layer on a circumferential surface of a hollow cylindrical rigid core roller. A driving shaft is axially inserted into the core roller, so that the pressure roller is rotatable around the driving shaft. The pressure roller is provided with a one-way clutch, so that a part of the pressure roller is allowed to undergo free rotation in a predetermined direction and to rotate at the same angular velocity as that of the driving shaft in the direction opposite to the predetermined direction.

The heating roller has a rubber layer formed on a circumferential surface of a hollow cylindrical rigid core roller and is pressed against the pressure roller to form the fixing nip portion. A rotational driving force is transmitted from one end of the driving shaft of the pressure roller. In this configuration, when the driving shaft is driven, the heating roller frictionally rotates the pressure roller at the nip portion to convey a sheet material bearing an unfixed toner image. During the conveyance, in order to prevent any change in the circumferential rotation speed of the pressure roller due to the change in the thickness of the sheet material or the shape condition of the nip portion, a configuration is employed in which the pressure roller is rotated at an angular velocity that is slightly higher than the angular rotation velocity of the driving shaft in the traveling direction of the sheet material.

Tear of a sheet material and distortion of an unfixed toner image are prevented when the heating roller frictionally rotates the pressure roller at the nip portion to convey the sheet material because the pressure roller is driven at substantially the same angular velocity as that of the driving shaft in the traveling direction of the sheet material by an action of the one-way clutch in case that a slip occurs due to unstable frictional rotation due to the width of the sheet material and the surface condition of the sheet material. It can be expected that a similar feature including a one-way clutch may be provided as part of a transmission unit such as a gear wheel that is provided separately rather than inside the pressure roller. However, such a configuration will result in a high cost because it makes the device complicated and large-sized.

SUMMARY OF THE INVENTION

It is therefore an object of the invention to provide an inexpensive fixing rubber roller in which a rubber layer securely formed on a circumferential surface of a rigid core roller is prevented from coming off the circumferential surface at longitudinal end face portions of the rubber layer.

It is also an object of the invention to provide a fixing device having a simple, compact, and inexpensive configuration by making a heating roller and a pressure roller coincide with each other in circumferential rotation speed and thereby causing them to function in a way in which tear of a sheet material or distortion of an unfixed toner image will not occur.

It is also an object of the invention to provide an image forming apparatus incorporating such a fixing rubber roller and a fixing device.

In order to achieve the above objects, according to the invention, there is provided a roller, comprising:

a cylindrical core member, comprising a first portion having a first diameter, a second portion having a second diameter which is smaller than the first diameter, and a step portion continuously connecting the first portion and the second portion; and a rubber layer, secured to an outer periphery of the core member so as to cover the first portion and a part of the step portion.

Preferably, a longitudinal end portion of the rubber layer is protruded from the step portion in an axial direction of the core member, so as to have a flat face extending in a direction perpendicular to the axial direction.

Preferably, both of a boundary between the first portion and the step portion and a boundary between the step portion and the second portion are rounded.

Preferably, the first portion is formed by applying a hydroforming work to a cylindrical member having the second diameter.

Preferably, the second portion is formed by applying a plastic work to a cylindrical member having the first diameter.

Preferably, the second portion is formed by applying a mechanical work to a cylindrical member having the first diameter. The rubber layer is secured so as to avoid a portion where the mechanical work is applied.

According to the invention, there is also provided a device for fixing a toner image on a recording medium, comprising:

a first roller, in which a heat source is incorporated; and a second roller, brought into contact with the first roller to form a nip portion therebetween through which the recording medium is passed, wherein at least one of the first roller and the second roller comprises:

a cylindrical core member, comprising a first portion having a first diameter, a second portion having a second diameter which is smaller than the first diameter, and a step portion continuously connecting the first portion and the second portion; and a rubber layer, secured to an outer periphery of the core member so as to cover the first portion and a part of the step portion.

According to the invention, there is also provided a device for fixing a toner image on a recording medium, comprising:

a first roller, in which a heat source is incorporated;

a heat-resistant belt member, stretched by a second roller and a stretcher and circulated therearound, the belt member brought into contact with the first roller to form a nip portion therebetween through which the recording medium is passed, wherein at least one of the first roller and the second roller comprises:

a cylindrical core member, comprising a first portion having a first diameter, a second portion having a second diameter which is smaller than the first diameter, and a step portion continuously connecting the first portion and the second portion; and a rubber layer, secured to an outer periphery of the core member so as to cover the first portion and a part of the step portion.

According to the invention, there is also provided an image forming apparatus for forming a toner image on a recording medium, comprising one of the above fixing devices.

According to the invention, there is also provided a roller, comprising:

a cylindrical core member, comprising a first portion having a first diameter, a second portion having a second diameter which is smaller than the first diameter, and a step portion continuously connecting the first portion and the second portion; and a rubber layer, secured to an outer periphery of the core member so as to cover the first portion, the step portion and a part of the second portion.

Preferably, a longitudinal end portion of the rubber layer is protruded from the step portion in an axial direction of the core member, so as to have a flat face extending in a direction perpendicular to the axial direction.

Preferably, both of a boundary between the first portion and the step portion and a boundary between the step portion and the second portion are rounded.

Preferably, the first portion is formed by applying a hydroforming work to a cylindrical member having the second diameter.

Preferably, the second portion is formed by applying a plastic work to a cylindrical member having the first diameter.

Preferably, the second portion is formed by applying a mechanical work to a cylindrical member having the first diameter. The rubber layer is secured so as to cover a portion where the mechanical work is applied.

According to the invention, there is also provided a device for fixing a toner image on a recording medium, comprising:

a first roller, in which a heat source is incorporated; and a second roller, brought into contact with the first roller to form a nip portion therebetween through which the recording medium is passed, wherein at least one of the first roller and the second roller comprises:

a cylindrical core member, comprising a first portion having a first diameter, a second portion having a second diameter which is smaller than the first diameter, and a step portion continuously connecting the first portion and the second portion; and a rubber layer, secured to an outer periphery of the core member so as to cover the first portion, the step portion and a part of the second portion.

According to the invention, there is also provided a device for fixing a toner image on a recording medium, comprising:

a first roller, in which a heat source is incorporated;

a heat-resistant belt member, stretched by a second roller and a stretcher and circulated therearound, the belt member brought into contact with the first roller to form a nip portion therebetween through which the recording medium is passed, wherein at least one of the first roller and the second roller comprises:

a cylindrical core member, comprising a first portion having a first diameter, a second portion having a second diameter which is smaller than the first diameter, and a step portion continuously connecting the first portion and the second portion; and a rubber layer, secured to an outer periphery of the core member so as to cover the first portion the step portion and a part of the second portion.

According to the invention, there is also provided an image forming apparatus for forming a toner image on a recording medium, comprising one of the above fixing devices.

According to the above configurations, it possible to prevent a rubber layer from coming off the outer periphery of the core member at or in the vicinity of the longitudinal end portion of the rubber layer, while eliminating unstable factors in the manufacturing steps with a simple structure and a low cost.

According to the invention, there is also provided a roller, comprising:

a cylindrical core member, comprising a first portion having a first diameter, a second portion having a second diameter which is smaller than the first diameter, and a step portion continuously connecting the first portion and the second portion;

a rubber layer, secured to an outer periphery of the core member so as to cover the first portion, the step portion and a part of the second portion; and a support member, provided on the rubber layer situated in the second portion so as to rotatably support the core member.

Preferably, a longitudinal end portion of the rubber layer has a flat face extending in a direction perpendicular to an axial direction of the core member.

Preferably, both of a boundary between the first portion and the step portion and a boundary between the step portion and the second portion are rounded.

Preferably, the first portion is formed by applying a hydroforming work to a cylindrical member having the second diameter.

Preferably, the second portion is formed by applying a plastic work to a cylindrical member having the first diameter.

Preferably, the second portion is formed by applying a mechanical work to a cylindrical member having the first diameter. The rubber layer is secured so as to cover a portion where the mechanical work is applied.

According to the invention, there is also provided a device for fixing a toner image on a recording medium, comprising:

a first roller, in which a heat source is incorporated; and a second roller, brought into contact with the first roller to form a nip portion therebetween through which the recording medium is passed, wherein at least one of the first roller and the second roller comprises:

a cylindrical core member, comprising a first portion having a first diameter, a second portion having a second diameter which is smaller than the first diameter, and a step portion continuously connecting the first portion and the second portion;

a rubber layer, secured to an outer periphery of the core member so as to cover the first portion, the step portion and a part of the second portion; and a support member, provided on the rubber layer situated in the second portion so as to rotatably support the core member.

According to the invention, there is also provided a device for fixing a toner image on a recording medium, comprising:

a first roller, in which a heat source is incorporated;

a heat-resistant belt member, stretched by a second roller and a stretcher and circulated therearound, the belt member brought into contact with the first roller to form a nip portion therebetween through which the recording medium is passed, wherein at least one of the first roller and the second roller comprises:

a cylindrical core member, comprising a first portion having a first diameter, a second portion having a second diameter which is smaller than the first diameter, and a step portion continuously connecting the first portion and the second portion; and a rubber layer, secured to an outer periphery of the core member so as to cover the first portion the step portion and a part of the second portion; and a support member, provided on the rubber layer situated in the second portion so as to rotatably support the core member.

According to the invention, there is also provided an image forming apparatus for forming a toner image on a recording medium, comprising one of the above fixing devices.

According to the above configurations, in addition to the above described advantages, it is possible not only to suppress loss of thermal energy supplied from the core member incorporating the heat source, but also to improve the durability of the support member because a rise in the temperature of the support member is suppressed by the rubber layer interposed between the core member and the support member.

According to the invention, there is also provided a device for fixing a toner image on a recording medium, comprising:

a first roller, comprising:

a heat source;

a rotatable, cylindrical first core member;

a first elastic member, rotatable together with the first core member;

a first rubber layer, secured to an outer periphery of the first core member; and a second roller, comprising:

a rotatable, cylindrical second core member;

a second elastic member, rotatable together with the second core member; and a second rubber layer, secured to an outer periphery of the second core member, and brought into contact with the first rubber layer to form a nip portion therebetween through which the recording medium is passed, and such that one of the first roller and the second roller is rotated by the rotation of the other, wherein the first elastic member and the second elastic member are brought into contact with each other at a position where is other than the nip portion.

According to the invention, there is also provided a device for fixing a toner image on a recording medium, comprising:

a first roller, comprising:

a heat source;

a rotatable, cylindrical first core member;

a first elastic member, rotatable together with the first core member;

a first rubber layer, secured to an outer periphery of the first core member; and a heat-resistant belt member, stretched by a second roller and a stretcher and circulated therearound, the second roller, comprising:

a rotatable, cylindrical second core member;

a second elastic member, rotatable together with the second core member; and a second rubber layer, secured to an outer periphery of the second core member, wherein:

the belt member is brought into contact with the first rubber layer to form a nip portion therebetween through which the recording medium is passed; and the first elastic member and the second elastic member are brought into contact with each other at a position where is other than the nip portion.

Preferably, the first elastic member has a hardness which is lower than a hardness of the first rubber layer; and the second elastic member has a hardness which is lower than a hardness of the second rubber layer.

Preferably, the above fixing device further comprises: a first support member, which rotatably supports the first roller; and a second support member, which rotatably supports the second roller. The first elastic member is arranged closer to a longitudinal end of the first roller than the first support member; and the second elastic member is arranged closer to a longitudinal end of the second roller than the second support member.

Here, it is preferable that: the first support member and the first elastic member are provided at each of longitudinal ends of the first roller; and the second support member and the second elastic member are provided at each of longitudinal ends of the second roller.

According to the invention, there is also provided an image forming apparatus for forming a toner image on a recording medium, comprising one of the above fixing devices.

According to the above configurations, it possible to make the first roller and the second roller coincide with each other in circumferential rotation speed by additional friction force generated by the contact rotation between the first elastic contact member and the second elastic contact member. Therefore, tear of a sheet material and distortion of an unfixed toner image can be avoided with a simple, compact, and inexpensive configuration.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
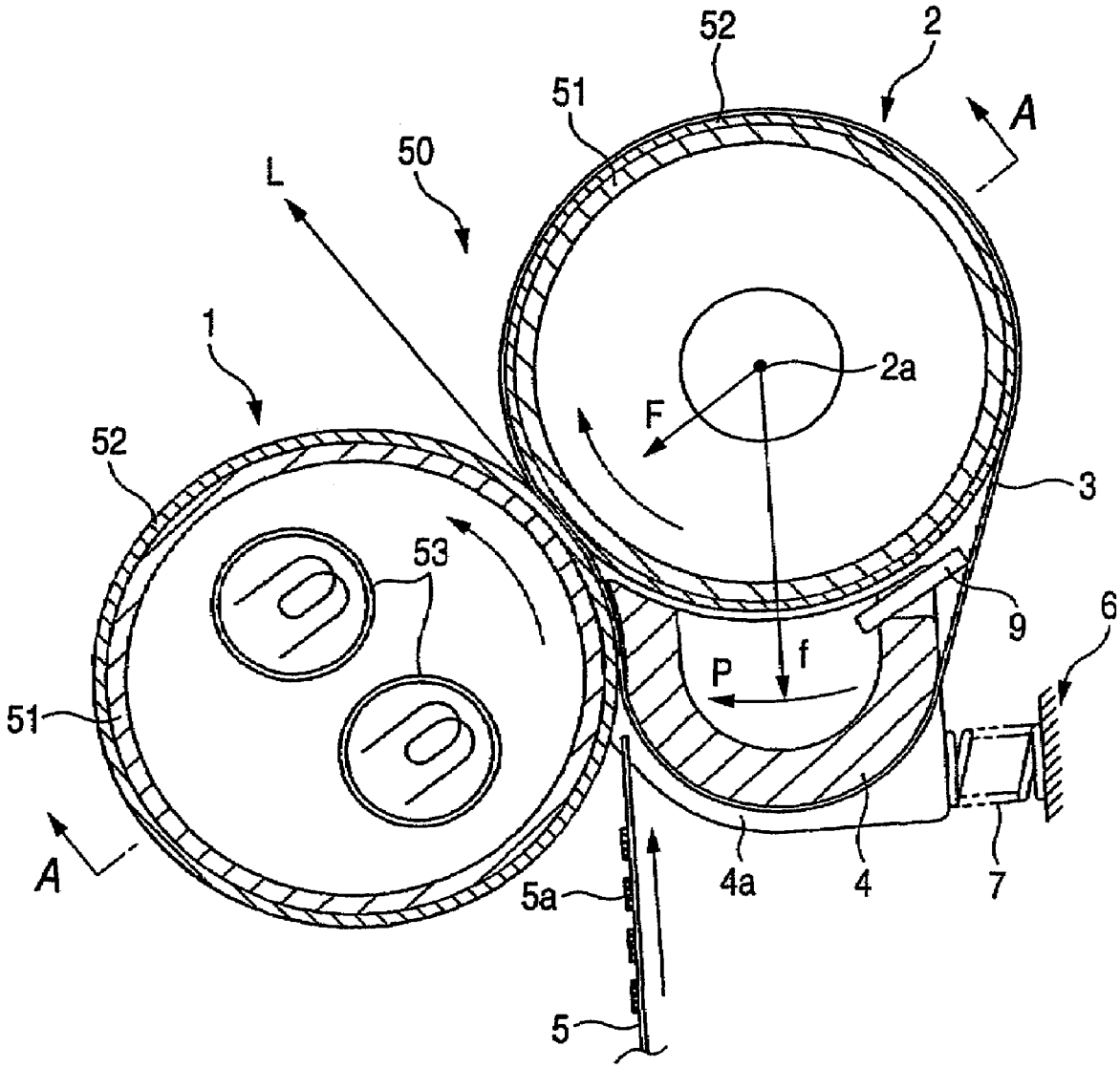
FIG. 1 is a sectional view showing a fixing device according to a first embodiment of the invention.

As shown in FIG. 1, a fixing device 50 according to a first embodiment of the invention is generally comprised of a heating roller 1, a pressure roller 2, a heat-resistant belt 3, and a belt stretcher 4.

The heating roller 1 is formed by securely bonding a rubber layer 52 having a thickness of about 0.4 mm to an outer circumferential surface of a rigid core roller 51 constituted by a metal pipe member having an outer diameter of about 25 mm and a thickness of about 0.7 mm. Two cylindrical halogen lamps of 1050 W as heat sources 53 are incorporated in the rigid core roller 51.

The pressure roller 2 is formed by securely bonding a rubber layer 52 having a thickness of about 0.2 mm to an outer circumferential surface of a rigid core roller 51 constituted by a metal pipe member having an outer diameter of about 25 mm and a thickness of about 0.7 mm. The pressure roller is configured to provide a pressing force of 10 kg or less and a nip with a length of about 10 mm between the heating roller 1 and the pressure roller 2, and it is constructed to be located opposite to the heating roller 1 and to be able to rotate in the direction of the arrow in the figure.

In this embodiment, since the heating roller 1 and the pressure roller 2 are configured with an outer diameter as small as about 25 mm, a sheet material which has been subjected to fixing will not stick to the heating roller 1 or the heat-resistant belt 3. Thus, there is no need for a unit for forcibly removing such a sheet material. When a PFA layer of about 30 μm is provided on the surface of the rubber layer 52 of the heating roller 1, the rigidity of the rubber layer is improved accordingly. As a result, the rubber layers undergo substantially uniform elastic deformation to form a so-called horizontal nip, although they are different in thickness, so that there will be no difference between the circumferential speed of the heating roller 1 and the conveying speed of the heat-resistant belt 3 or a sheet material 3. Thus, an image can be fixed with very high stability.

In this embodiment, the two heat sources 53 are incorporated in the heating roller 1. When heating elements of the halogen lamps are provided in different positions and selectively turned off, temperature control can be easily performed under different conditions such as those encountered between a nip portion where the heat-resistant belt 3 is wound around the heating roller 1 as described later and a region where the belt stretcher 4 slides in contact with the heating roller 1, and between a wide sheet material and a narrow sheet material.

The heat-resistant belt 3 is an endless belt which is movably stretched around the outer circumferences of the pressure roller 2 and the belt stretcher 4, the belt 3 being sandwiched between the heating roller 1 and the pressure roller 2. It is constituted by metal tubes such as stainless steel tubes or electroformed nickel tubes having a thickness of 0.03 mm or more or heat-resistant resin tubes made of polyimide or silicon.

The belt stretcher 4 is disposed upstream of the nip portion between the heating roller 1 and the pressure roller 2 when viewed in the conveying direction of the sheet material 5 and is disposed such that it can swing in the direction of the arrow P relative to a rotating shaft center 2*a* of the pressure roller 2. The belt stretcher 4 is configured to stretch the heat-resistant belt 3 tangentially to the heating roller 1 when the sheet material 5 is not passing through the nip portion. It is known that the material would not enter into the nip portion smoothly, and fixing may be performed with the end of the sheet material folded in a case where there is a great fixing pressure in an initial position where the sheet material 5 enters the nip portion. However, with the configuration in which the heat-resistant belt 3 is stretched tangentially to the heating roller 1, an inlet portion can be formed to allow the sheet material 5 to enter smoothly, thereby allowing stable entry of the sheet material.

The belt stretcher 4 is a substantially semiannular member on which the heat-resistant belt 3 slides which is fitted to the inner circumference of the heat-resistant belt 3 so as to cooperate with the pressure roller 2 in applying a tensile force f to the heat-resistant belt 3 and which is positioned so as to wind the heat-resistant belt 3 around the heating roller 1 and to thereby form a nip between them. The belt stretcher 4 is provided in such a position that the heat-resistant belt 3 is wound to form a nip that is shifted toward the heating roller 1 from a tangent L to the region where the heating roller 1 and the pressure roller 2 are pressed against each other. A protruding wall 4*a* protrudes from one or both widthwise ends of the belt stretcher 4 to limit a bias of the heat-resistant belt 3 by abutting on the belt when it is biased in one widthwise direction. A spring 7 is disposed between an end of the protruding wall 4*a* opposite to the heating roller 1 and an apparatus frame 6. Thus, the protruding wall 4*a* of the belt stretcher 4 is lightly pressed against the heating roller 1, and the belt stretcher 4 is positioned such that it can slide in contact with the heating roller 1.

In order to stretch the heat-resistant belt 3 with the pressure roller 2 and the belt stretcher 4 and to drive it stably with the pressure roller 2, the coefficient of friction between the pressure roller 2 and the heat-resistant belt 3 may be set greater than the coefficient of friction between the belt stretcher 4 and the heat-resistant belt 3. However, the coefficients of friction can become unstable because of the invasion of foreign substances and abrasion. On the contrary, a setting may be made such that the angle of winding of the heat-resistant belt 3 around the belt stretcher 4 is smaller than the angle of winding of the heat-resistant belt 3 around the pressure roller 2 and such that the curvature radius of the belt stretcher 4 is smaller than the curvature radius of the pressure roller 2. As a result, the heat-resistant belt 3 slides on the belt stretcher 4 a small distance, which makes it possible to eliminate factors that are unstable under changes with time and disturbances and allows the heat-resistant belt 3 to be stably driven by the pressure roller.

A cleaning member 9 is provided between the pressure roller 2 and the belt stretcher 4 and slides in contact with an inner circumferential surface of the heat-resistant belt 3 to clean the inner circumferential surface of the heat-resistant belt 3 of any foreign substance and particles resulting from abrasion. The heat-resistant belt 3 is refreshed to eliminate unstable factors by removing such foreign substances and particles resulting from abrasion.

The sheet material 5 is passed between the heat-resistant belt 3 and the heating roller 1 via a nip start position that is a position where the belt stretcher 4 is lightly pressed against the heating roller 1 to fix an unfixed toner image 5*a* thereon, and it is ejected in the direction of the tangent L to the pressing region via a nip end position that is a position where the pressure roller 2 is pressed against the heating roller 1.

In the above-described fixing device 50, since the heat-resistant belt 3 moves through a minimum required path, it is possible to minimize thermal energy lost when the heat-resistant belt 3 moves through the predetermined path after being heated at a nip portion between the rotatable heating roller 1 incorporating heat sources and itself. Further, since the belt has a small circumferential length, there is only a small decrease in the temperature of the same attributable to natural heat radiation, and it is possible to reduce a so-called warming up time since the power is turned on until a predetermined temperature is reached to enable fixing.

Since the heat-resistant belt 3 is tensioned and wound around the heating roller 1 to form the nip as a result of cooperation between the pressure roller 2 and the belt stretcher 4, a configuration to achieve a great nip length can be easily provided, which makes it possible to provide a simple structure and to achieve downsizing and a cost reduction.

In order to fix the unfixed toner image 5*a* formed on the sheet material 5 with stability, it is essential to sufficiently fuse the unfixed toner image 5*a* before fixing, which requires predetermined temperature and fusing time. In the configuration according to the invention, since there is no need for a unit for increasing the nip length by greatly deforming an elastic member covering the surface of the heating roller 1, the elastic member may be configured with a small thickness. In addition, there is no need for setting a great contact pressure for the pressure roller 2 in order to deform the elastic member, and the sheet material 5 carrying the unfixed toner image 5*a* is subjected to a small stress when it passes between the heating roller 1 and the heat-resistant belt 3, deformation such as the generation of wrinkles is suppressed on the sheet material 5 that is ejected after the unfixed toner image 5*a* is fixed.

Therefore, it is not necessary to increase the mechanical rigidity of the thermal roller type fixing device, and the thickness of the heating roller 1 can be reduced to improve the speed of heating of the heat-resistant belt 3 with the heat sources. Further, since the pressure roller 2 can be similarly provided with a small thickness and configured to have a small thermal capacity, it absorbs only a small amount of thermal energy from the heat-resistant belt 3, and it is therefore possible to reduce the so-called warming up time since the power is turned on until the predetermined temperature is reached to enable fixing.

A structure for supporting the heating roller 1 and the pressure roller 2 will now be described with reference to FIG. 2. In the following description, features that are identical between the drawings will be indicated by the same reference numbers, and repetitive explanations will be omitted.

The rigid core rollers 51 of the heating roller 1 and the pressure roller 2 are formed with a large diameter portion 51*a* having a width greater than the width of the heat-resistant belt 3, small diameter portions 51*b* having a diameter smaller than that of the large diameter portion 51*a* formed on both ends of the large diameter portion 51*a*, and side portions 51*c* formed between the large diameter portion 51*a* and the small diameter portions 51*b* continuously with them.

Stop rings 54 are secured to the small diameter portions 51*b* of the heating roller 1 and the pressure roller 2, and heat insulating bushes 55 are secured between the stop rings 54 and the rubber layers 52. Bearings 56 are disposed between the heat insulating bushes 55 and a frame 6 to provide a configuration in which the heating roller 1 and the pressure roller 2 can rotate.

A driving gear 57 is fitted and secured to the rotary shaft (small diameter portion) 51*b* of the pressure roller 2. An elastic contact member 59 is fitted and secured adjacent to the driving gear 57. An elastic contact member 60 is fitted and secured to the rotary shaft (small diameter portion) 51*b* of the heating roller 1. The elastic contact members 59 and 60 are opposed and pressed against each other. The driving gear 57 is coupled to a driving source which is not shown, and a rotation of the driving gear 57 causes the pressure roller 2 to rotate. The heating roller 1 is rotated by rotation of the pressure roller 2 with the assistance of a frictional driving force of the elastic contact members 59 and 60.

There is probability that slipping is occurred when a sheet material 5 bearing an unfixed toner image thereon is conveyed at a nip portion N if a friction force generated thereat is insufficient. Such a situation may be caused in a case where a PFA layer is formed on the rubber layer 52 of the heating roller 1 to prevent unfixed toner image on a sheet material 5 from adhering thereon, and there is a region where the heat-resistant belt 3 is directly brought into contact with such a rubber layer 52 because the width of the sheet material 5 is smaller than the width of the heat-resistant belt 3 and the heating roller 1. The above situation may also be caused in a case where the surface of the sheet material 5 is slippery.

However, in this embodiment, since the elastic contact members 59 and 60 provides sufficient friction force between the heating roller 1 and the pressure roller 2, the circumferential rotation speeds of the both rollers are matched with each other, so that the slipping of the sheet material 5 can be avoided with a simple and compact structure, even in the above cases. Accordingly, tear of a sheet material or distortion of an unfixed toner image can be avoided.

The elastic contact members 59 and 60 are constituted by cylindrical members 59*a* and 60*a* secured to the rotary shaft 51*b* and rubber layers 59*b* and 60*b* bonded to outer circumferential surfaces of the cylindrical members 59*a* and 60*a*. Referring to the hardness of the rubber layers of the elastic contact members 59 and 60, rubber layers are used which have hardness lower than that of the rubber layers 52 of the heating roller 1 and the pressure roller 2.

The heating roller 1 and the pressure roller 2 have manufacturing errors in twisting of the rigid core roller 51, twisting of the rubber layer 52, and the outer diameter of the rubber layer 52, and either of the rollers is not always driven under constant conditions because of reasons such as a change in the thickness of a sheet material bearing an unfixed toner image. However, according to the above configuration, the rubber layers 59*b* and 60*b* deform in adaptation to the inconstant conditions as described above, thereby providing a frictional force assisting the frictional force generated at the nip portion N.

In this embodiment, the elastic contact members 59 and 60 are provided outside the bearings 56 which support the rotation of the heating roller 1 and the pressure roller 2. In the structure in which the pressure roller 2 is provided and pressed against the heating roller 1 to form the nip portion N and in which each of the heating roller I and the pressure roller 2 is rotatably supported at both ends thereof, the shafts of the rollers are deflected in the direction of spacing the rollers from each other, so that, at the inner side of the bearings 56, the defection increasing toward a maximum deflection at the longitudinal center of the rollers.

Since the rollers move toward each other at the outer side of the bearings 56 as a reaction to the deflection of the shafts, by providing the elastic contact members 59 and 60 at the outer side of the bearings 56 of the heating roller 1 and the pressure roller 2, an effect of canceling the reaction can be achieved to reduce the deformation of the shafts and to allow a stable nip portion N to be formed.

Although the assistant frictional force can be provided even in a case where the elastic contact members 59 and 60 are disposed at the inner side of the bearings 56, this approach is not preferable in that the span between the bearings 56 is increased to increase the deflection of the rollers.

By providing the elastic contact members 59 and 60 on both ends of the heating roller 1 and the pressure roller 2 at the outer side of the bearings 56, the effect of canceling the reaction to the deflection of the shafts can be exhibited in good balance on both sides of the rollers, which makes it to possible to form a more stable nip portion N.

Although the pressure roller 2 is driven to rotate the heating roller 1 in this embodiment, the heating roller 1 may alternatively driven to rotate the pressure roller 2.

Hereinafter, the heating roller 1 and the pressure roller 2 are collectively referred to as a fixing rubber roller. The rubber layer 52 of a fixing rubber roller is secured to an area covering the circumferential surface of the large diameter portion 51*a* and part of the side portions 51*c*.

Figure 3:
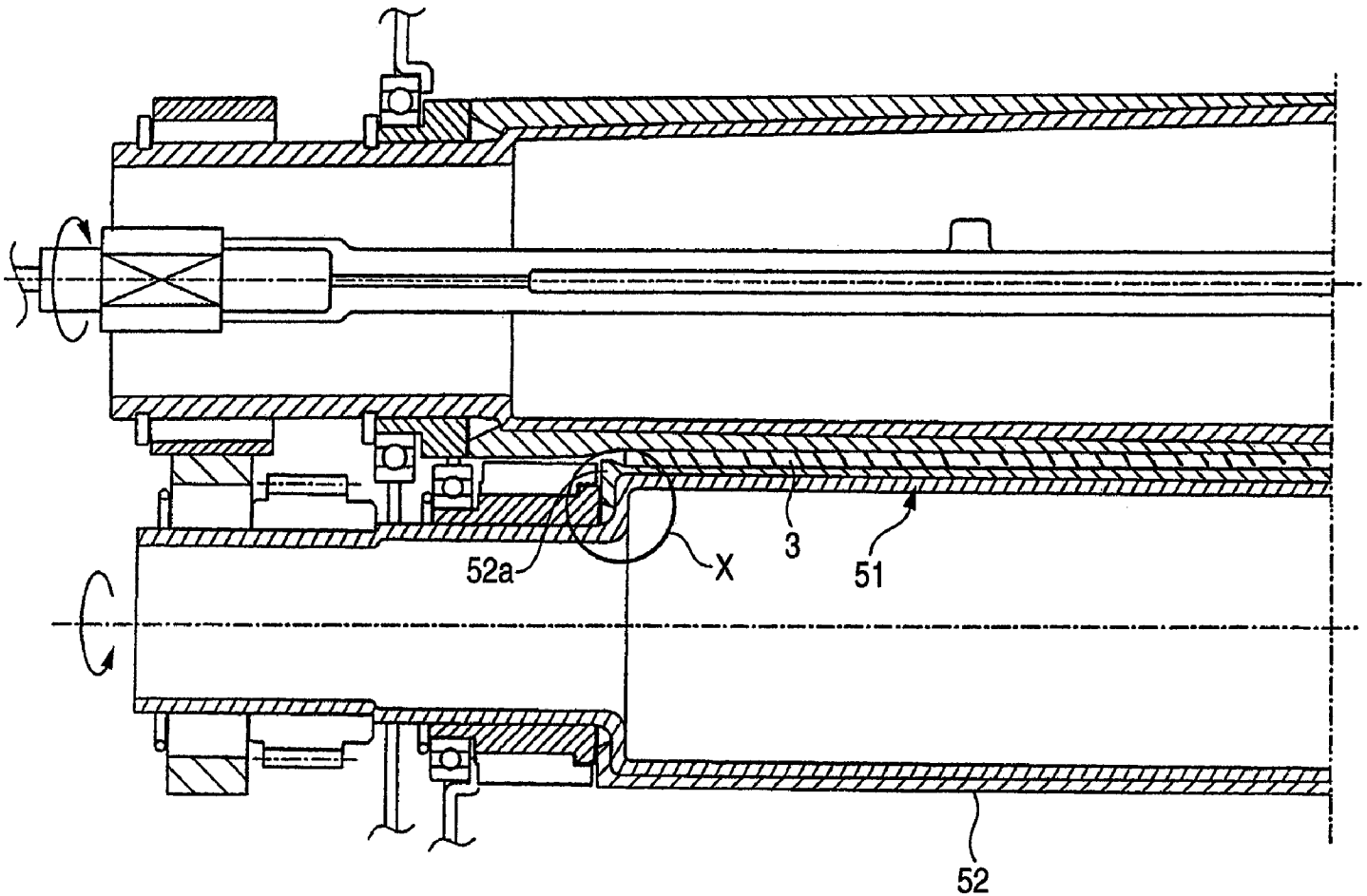
FIG. 3 is a partial sectional view of the fixing device in a rotating state.

This not only results in securing strength higher than that achievable when the rubber layer is bonded only to the circumferential surface of the large diameter portion 51*a* as done in the related art, but also makes the rubber layer 52 more apt to bulgingly deform in operation as indicated by X in FIG. 3 because the thickness of the rubber layer 52 is increased at the ends of the rubber layer 52. It is therefore possible to reduce bulging stress that acts on the end portions 52*a* of the rubber layer 52 when the rollers rotate while being pressed with each other. Accordingly, the rubber layer 52 is prevented from coming off the circumferential surface of the rigid core roller 51 at or in the vicinity of the end portions thereof.

A fixing rubber roller must have a function of fixing an unfixed toner image at a high temperature on the level of about 200° C. When the roller is supported at rotational supporting portions 51*f* on both ends thereof and heated to the high temperature, it expands about 1 mm in the axial direction thereof in the case of a sheet material of A3 size. When the rigid core roller 51 is guided and rotatably supported, it is necessary to configure a structure in which a clearance is provided in advance in the axial direction to absorb such expansion.

In this embodiment, the end portions 52*a* of the rubber layer 52 are formed such that they protrude in the axial direction from the circumferential surface of the large diameter portion 51*a* and the side portions 51*c* and they have at least a flat face perpendicular to the axial direction. The flat faces are abutted against members for supporting the rotation of the fixing rubber roller (in this embodiment, the heat insulating bushes 55). As a result, the expansion in the axial direction is absorbed by compression of the end portions 52*a* without providing a great clearance, which allows stable support.

Figure 2:
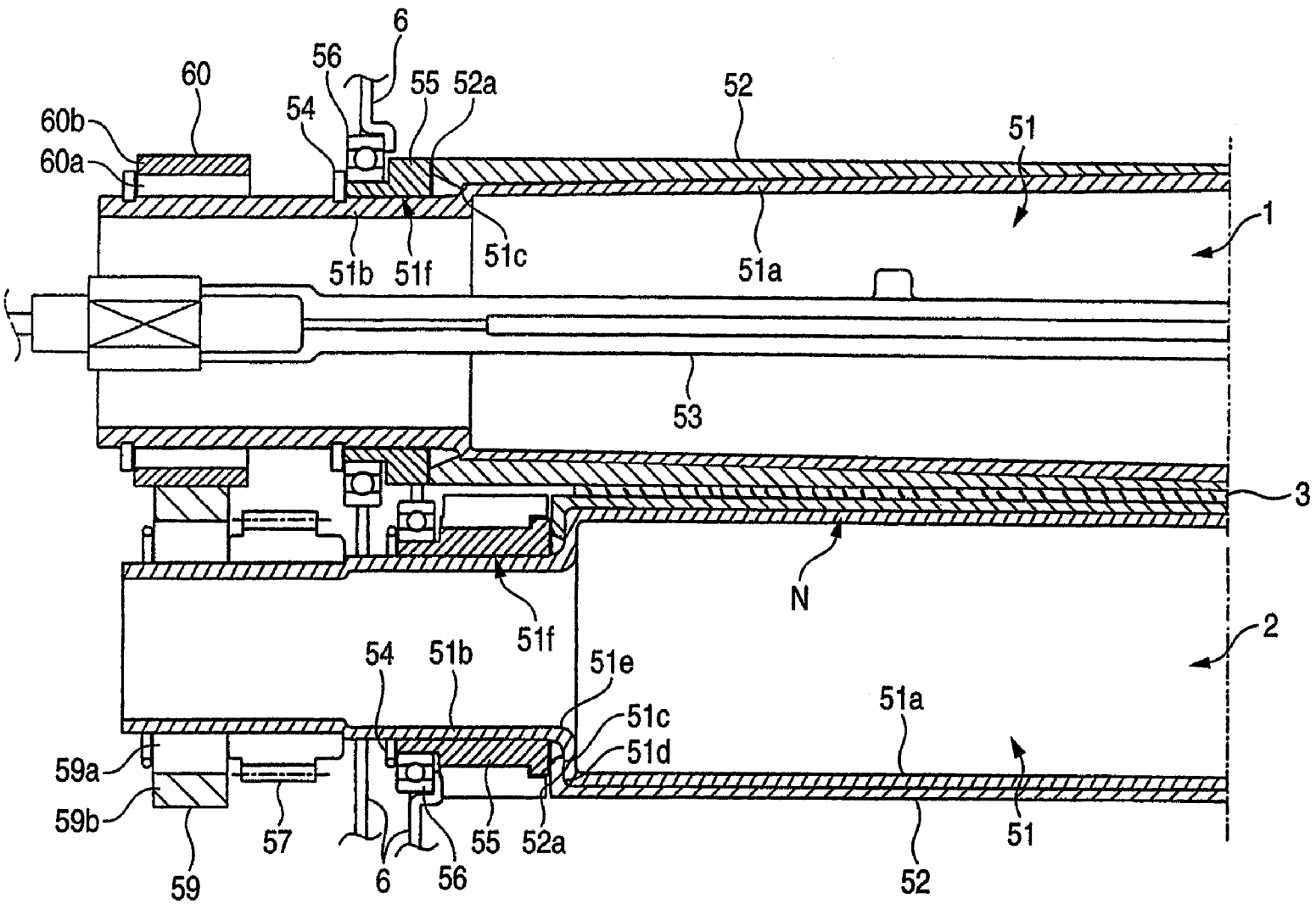
FIG. 2 is a partial sectional view of the fixing device taken in the direction of the arrow along the line A-A in FIG. 1.
Figure 4:
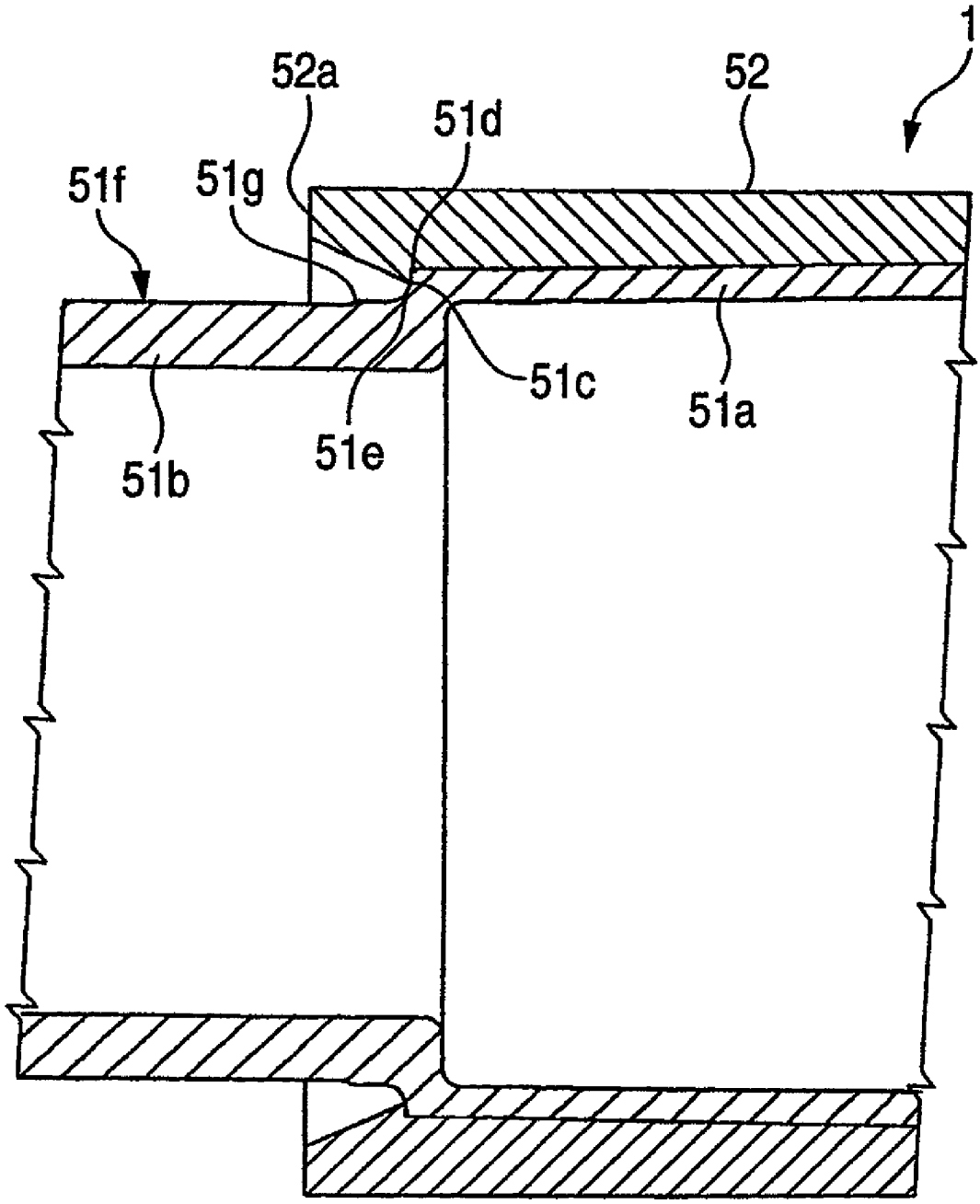
FIG. 4 is an enlarged sectional view of part of a heating roller shown in FIG. 2.
Figure 5:
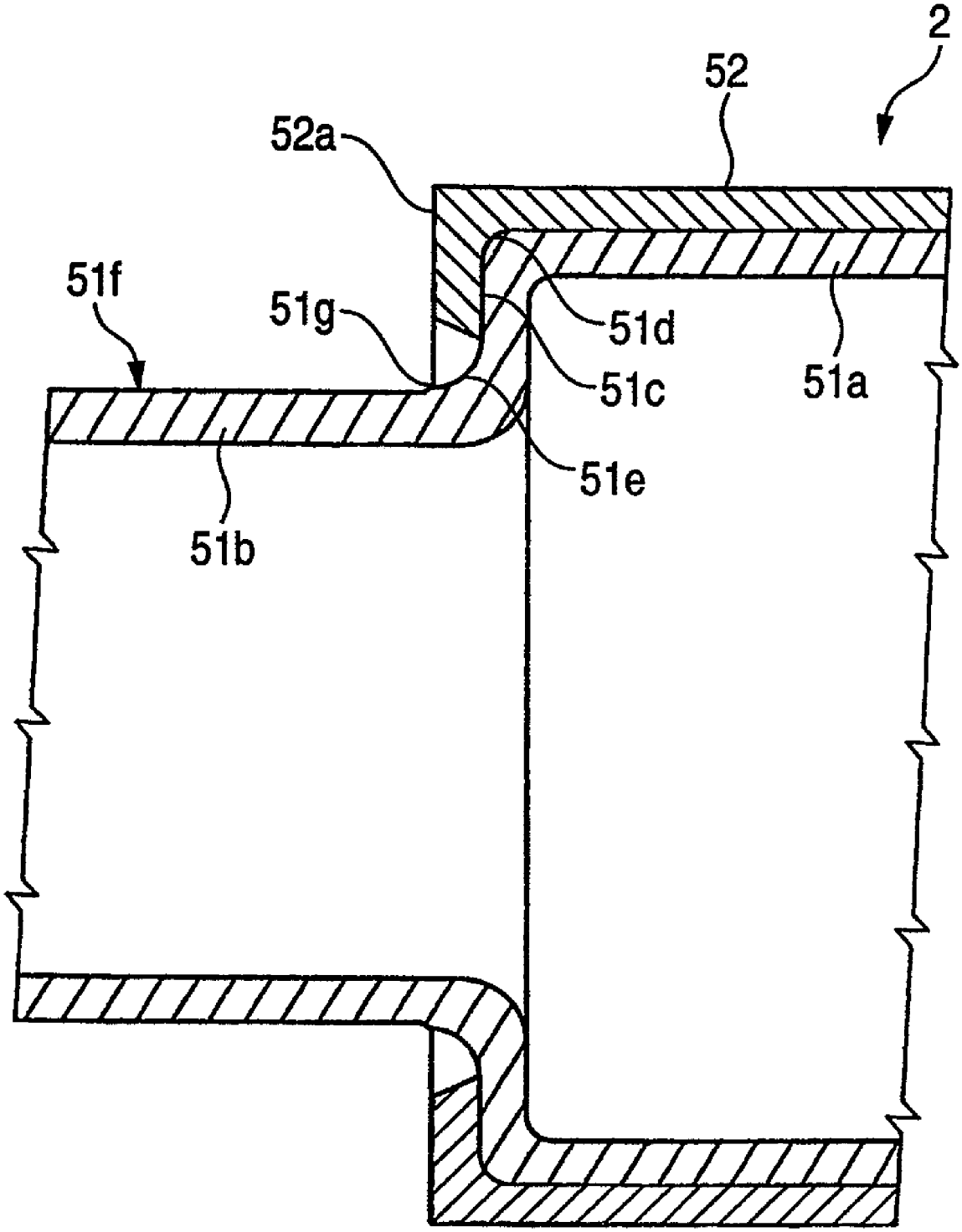
FIG. 5 is an enlarged sectional view of part of a pressure roller shown in FIG. 2.
Figure 6:
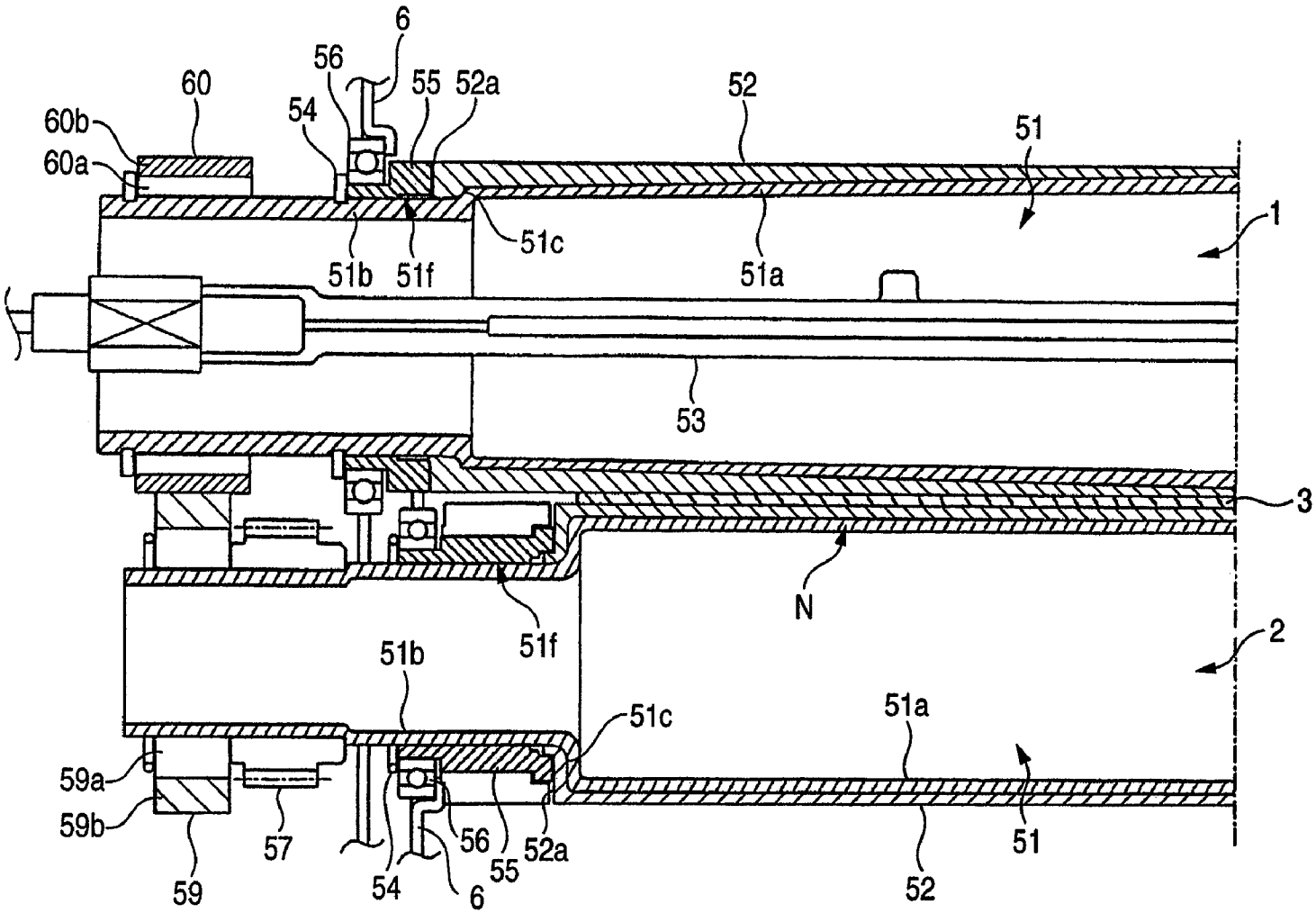
FIG. 6 is a partial sectional view of a fixing device according to a second embodiment of the invention.

As shown in FIGS. 2, 4 and 5, curved portions 51*d* between the large diameter portion 51*a* and the side portions 51*c* of the rigid core roller 51 and curved portions 51*e* between the side portions 51*c* and the small diameter portions 51*b* are formed as curved corners so as to smoothly connecting these portions. As a result, securing strength between the rubber layer 52 and the rigid core roller 51 is improved on the surface of the side portions 51*c*. In addition, even when the rubber layer 52 is bulgingly deformed, the securing strength can be maintained. Thus, when the roller rotates while being pressed against the roller provided opposite thereto, it is possible to prevent the rubber layer from coming off the circumferential surface of the rigid core roller 51 at or in the vicinity of the end portions 52*a* of the rubber layer 52.

The rigid core roller 51 having the small diameter portions 51*b* continuously formed on both ends of the large diameter portion 51*a* is formed using plastic working in which a metal pipe material is expanded using a bulging work (hydroforming work) or reduced using a reduction work. The shape of the curved portions 51*d* may become unstable according to this method. However, in a configuration in which the rubber layer 52 is secured to an area covering the circumferential surface of the large diameter portion 51*a* and a part of the side portions 51*c* as in this embodiment, there is no restriction on the shape of the curved portions 51*d* because they are entirely covered with the rubber layer 52.

An important requirement for a fixing rubber roller is to maintain the stability of the conveying speed of a sheet material by arranging the rotational supporting portions 51*f* and the rubber layer 52 concentrically to rotate them stably. In order to maintain the precision of the rotational supporting portions 51*f*, it is preferable to finish part of the small diameter portions 51*b* by performing a mechanical work such as cutting, grinding or varnishing. However, when there is non-uniformity in the shapes of the side portions 51*c* and the positions of the curved portions 51*e* during a mechanical work as described above, shapes finished by the mechanical work and positions of them may be unstable. In FIGS. 4 and 5, reference numeral 51*g* indicates a position finished by mechanical work.

In this embodiment, since an end of the rubber layer 52 is secured excluding a portion (finished position) 51*g* formed by performing mechanical work, the unstable portion has nothing to do with the formation of the rubber layer 52. Thus, the rubber layer 52 can be provided with a very simple structure at a low cost because there is no factor restricting the formation of the rubber layer 52.

Although the heating roller 1 and the pressure roller 2 in this embodiment are rubber rollers, it is also possible to form at least either of the heating roller 1 and the pressure roller 2 as a rubber roller. Although this embodiment is applied to a fixing device having a heat-resistant belt 3, it may be applied to a fixing device of a type in which a heating roller 1 and a pressure roller 2 are directly pressed against each other in a face-to-face relationship.

A structure of a fixing rubber roller according to a second embodiment will now be described with reference to FIGS. 6 to 9. Members similar to those in the first embodiment will be designated by the same reference numerals and the repetitive explanations will be omitted.

In this embodiment, the rubber layer 52 of a fixing rubber roller is secured to an area covering the circumferential surface of the large diameter portion 51*a*, the side portions 51*c*, and a part of the circumferential surface of the small diameter portions 51*b*.

Figure 7:
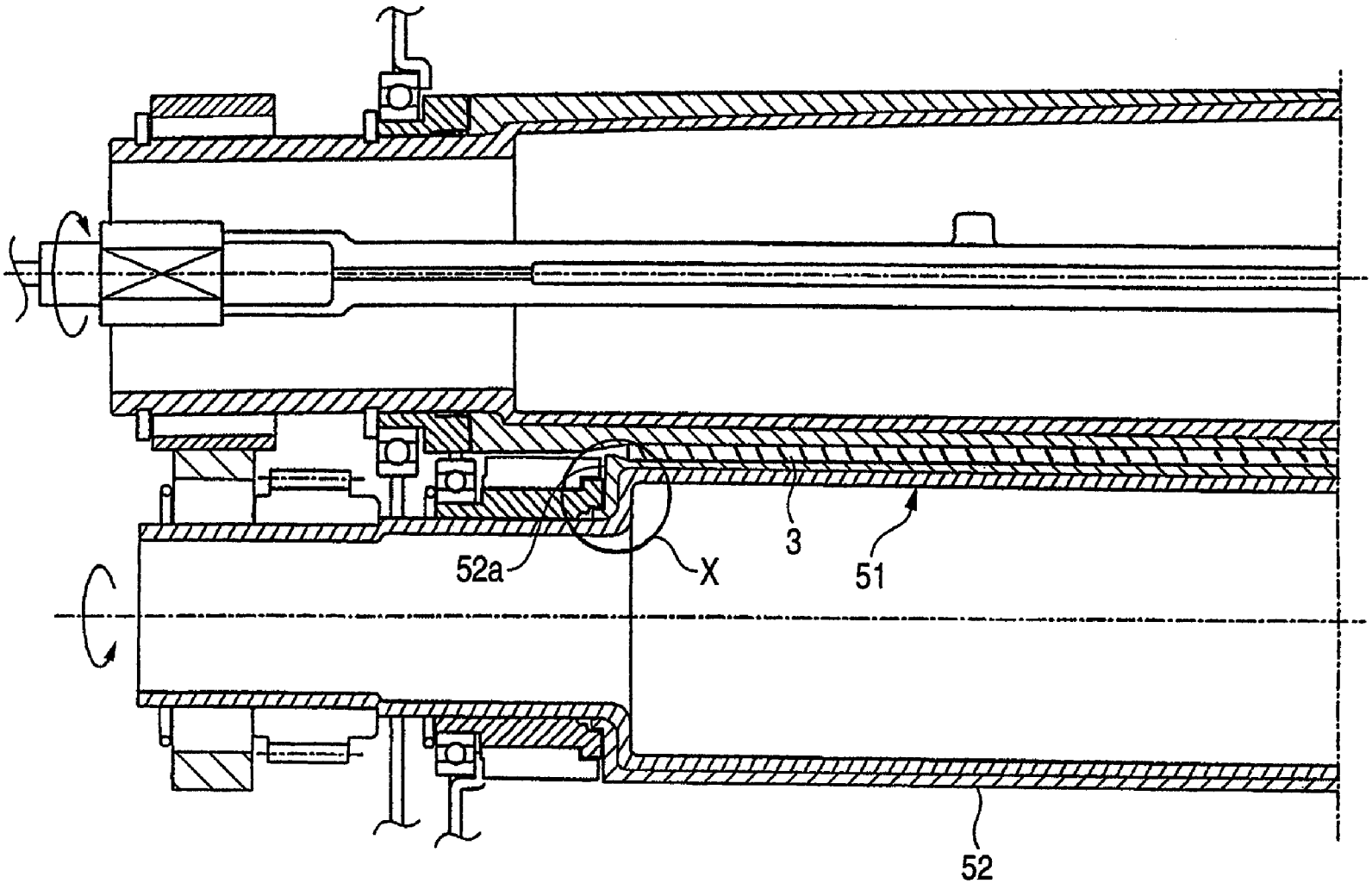
FIG. 7 is a partial sectional view of the fixing device shown in FIG. 6 in a rotating state.

This not only results in securing strength higher than that achievable when the rubber layer is bonded only to the circumferential surface of the large diameter portion 51*a* as done in the related art, but also makes the rubber layer 52 more apt to bulgingly deform in operation as indicated by X in FIG. 7 because the thickness of the rubber layer 52 is increased at the ends of the rubber layer 52. It is therefore possible to reduce bulging stress that acts on the end portions 52*a* of the rubber layer 52 when the rollers rotate while being pressed with each other. Accordingly, the rubber layer 52 is prevented from coming off the circumferential surface of the rigid core roller 51 at or in the vicinity of the end portions thereof.

The rigid core roller 51 having the small diameter portions 51*b* continuously formed on both ends of the large diameter portion 51*a* is formed using plastic working in which a metal pipe material is expanded using a bulging work or reduced using a reduction work. The shape of the curved portions 51*d* may become unstable according to this method. However, in a configuration in which the rubber layer 52 is secured to an area covering the circumferential surface of the large diameter portion 51*a*, the side portions 51*c* and a part of the small diameter portions 51*b* as in this embodiment, there is no restriction on the shape of the curved portions 51*d* and 51*e* because they are entirely covered with the rubber layer 52.

Figure 8:
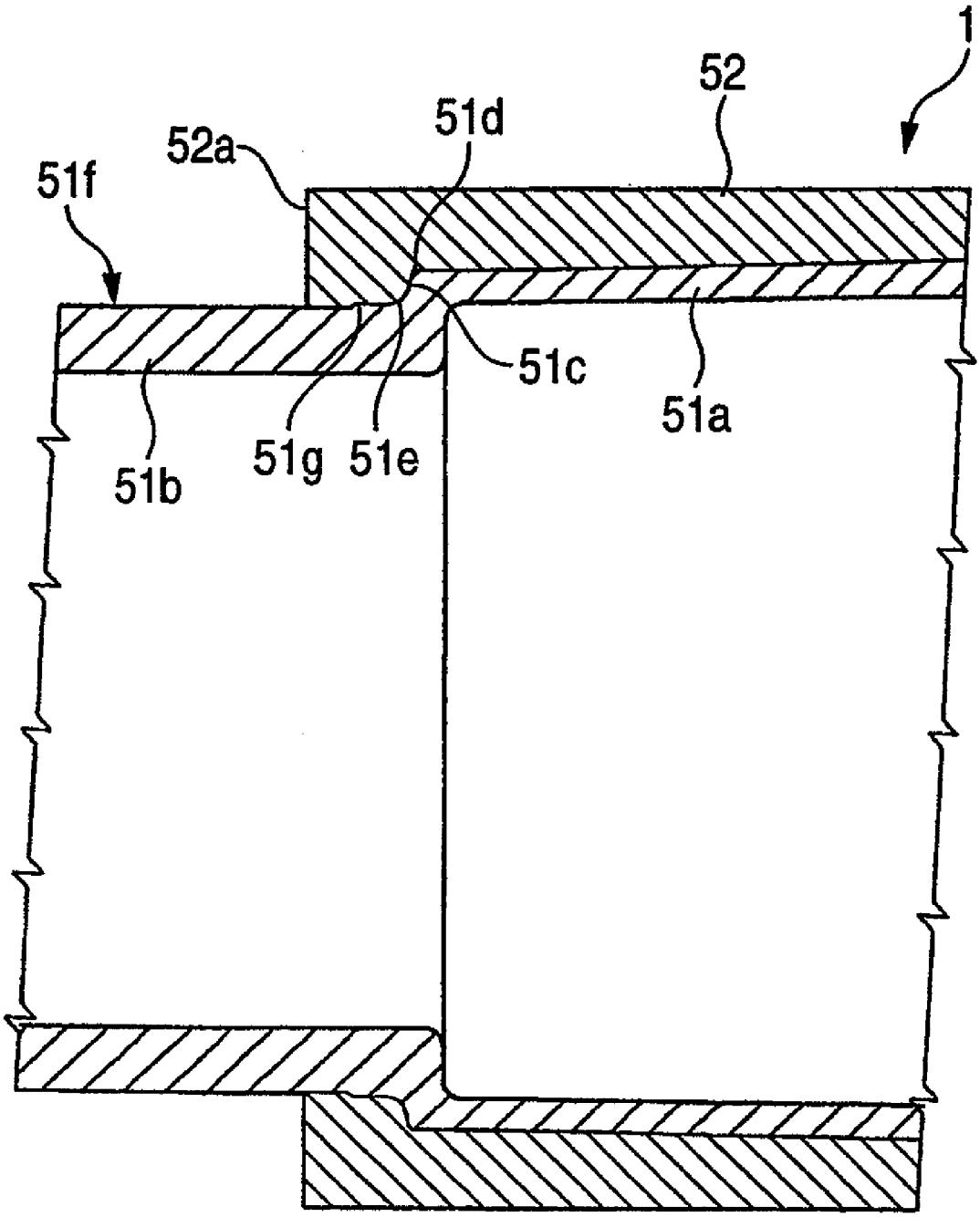
FIG. 8 is an enlarged sectional view of part of a heating roller shown in FIG. 6.
Figure 9:
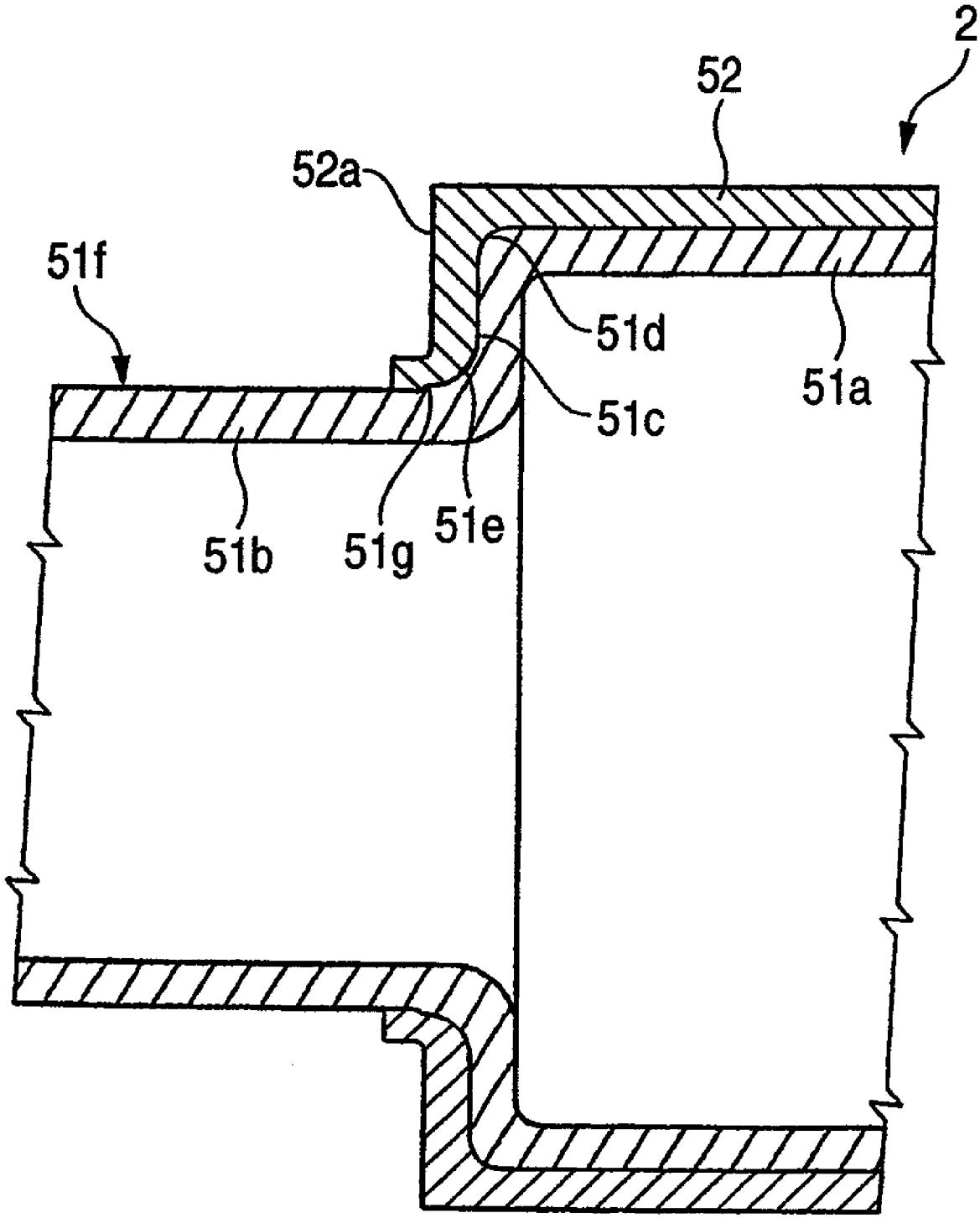
FIG. 9 is an enlarged sectional view of part of a pressure roller shown in FIG. 6.
Figure 10:
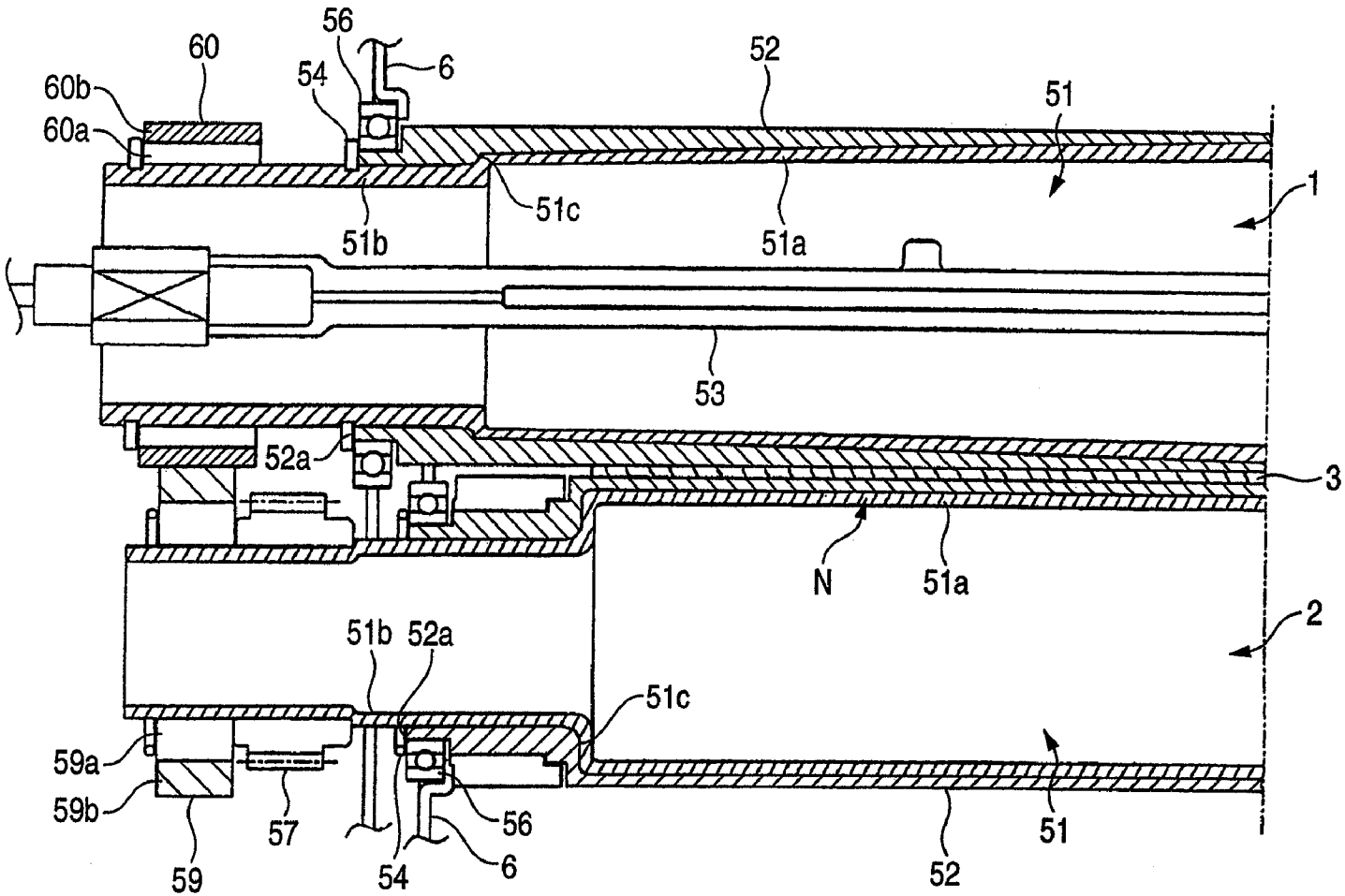
FIG. 10 is a partial sectional view of a fixing device according to a third embodiment of the invention.

As shown in FIGS. 8 and 9, an end of the rubber layer 52 is secured such that at least the portion 51*g* finished by mechanical work (described the above in detail) is covered as in the as in the present embodiment, the unstable portions are entirely covered with the rubber layer 52. Thus, the rubber layer 52 can be provided with a very simple structure at a low cost because there is no factor restricting the formation of the rubber layer.

A structure of a fixing rubber roller according to a third embodiment will now be described with reference to FIGS. 10 to 13. Members similar to those in the first embodiment will be designated by the same reference numerals and the repetitive explanations will be omitted.

In this embodiment, the rubber layer 52 of a fixing rubber roller is secured to an area covering the circumferential surface of the large diameter portion 51*a*, the side portions 51*c*, and a part of the circumferential surface of the small diameter portions 51*b*. The end portions 52*a* of the rubber layer is abutted against the stopper rings 54. The bushes 55 are not provided.

Figure 11:
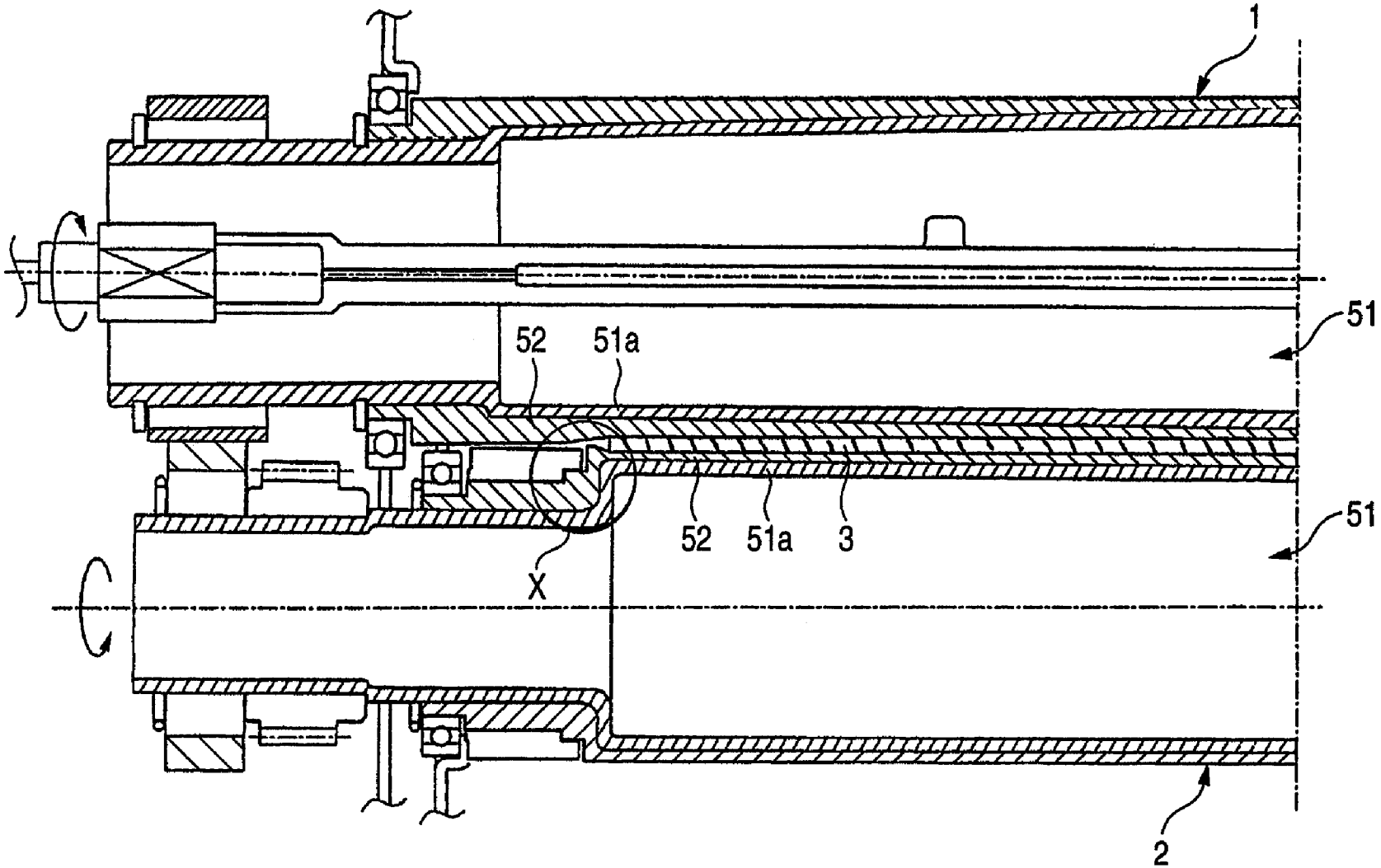
FIG. 11 is a partial sectional view of the fixing device shown in FIG. 10 in a rotating state.

This not only results in securing strength higher than that achievable when the rubber layer is bonded only to the circumferential surface of the large diameter portion 51*a* as done in the related art, but also makes the rubber layer 52 more apt to bulgingly deform in operation as indicated by X in FIG. 11 because the thickness of the rubber layer 52 is increased at the ends of the rubber layer 52. It is therefore possible to reduce bulging stress that acts on the end portions 52*a* of the rubber layer 52 when the rollers rotate while being pressed with each other. Accordingly, the rubber layer 52 is prevented from coming off the circumferential surface of the rigid core roller 51 at or in the vicinity of the end portions thereof.

Since the rubber layer 52 is disposed on inner faces of the bearings 56, even when the fixing rubber roller is heated to about 200° C. from inside or outside thereof, the rubber layer 52 having a heat insulating function exhibits an effect of insulating the bearings 56 from heat to suppress heat transmission from the fixing rubber roller. It is therefore possible not only to suppress loss of thermal energy of the fixing rubber roller but also to improve the durability of the bearings 56 because an increase in the temperature of the bearings 56 is suppressed. Accordingly, the heat insulating bushes 55 used in the first and second embodiments can be omitted here.

Even when a pressing force is applied to the end portions 52*a* disposed between the fixing roller and the bearings 56, such a force is distributed to moderate the local stress unlike the nip portion N at which the rubber layers of the fixing rollers are tangentially brought into contact with each other. This prevents the problem in which the rubber layer 52 comes off the circumferential surface of the rigid core roller 51 at or in the vicinity of the ends thereof. If the end portions 52*a* undergo unpreferable elastic deformation, the thickness thereof may be reduced.

In this embodiment, the end portions 52*a* of the rubber layer 52 are formed such that they have at least a flat face perpendicular to the axial direction. The flat faces are abutted against the stop rings 54. As a result, the expansion in the axial direction of the fixing rubber roller due to heat for fixing is absorbed by compression of the end portions 52*a* without providing a great clearance, which allows stable support.

The rigid core roller 51 having the small diameter portions 51*b* continuously formed on both ends of the large diameter portion 51*a* is formed using plastic working in which a metal pipe material is expanded using a bulging work or reduced using a reduction work. The shape of the curved portions 51*d* may become unstable according to this method. However, in a configuration in which the rubber layer 52 is secured to an area covering the circumferential surface of the large diameter portion 51*a*, the side portions 51*c* and a part of the small diameter portions 51*b* as in this embodiment, there is no restriction on the shape of the curved portions 51*d* and 51*e* because they are entirely covered with the rubber layer 52.

Figure 12:
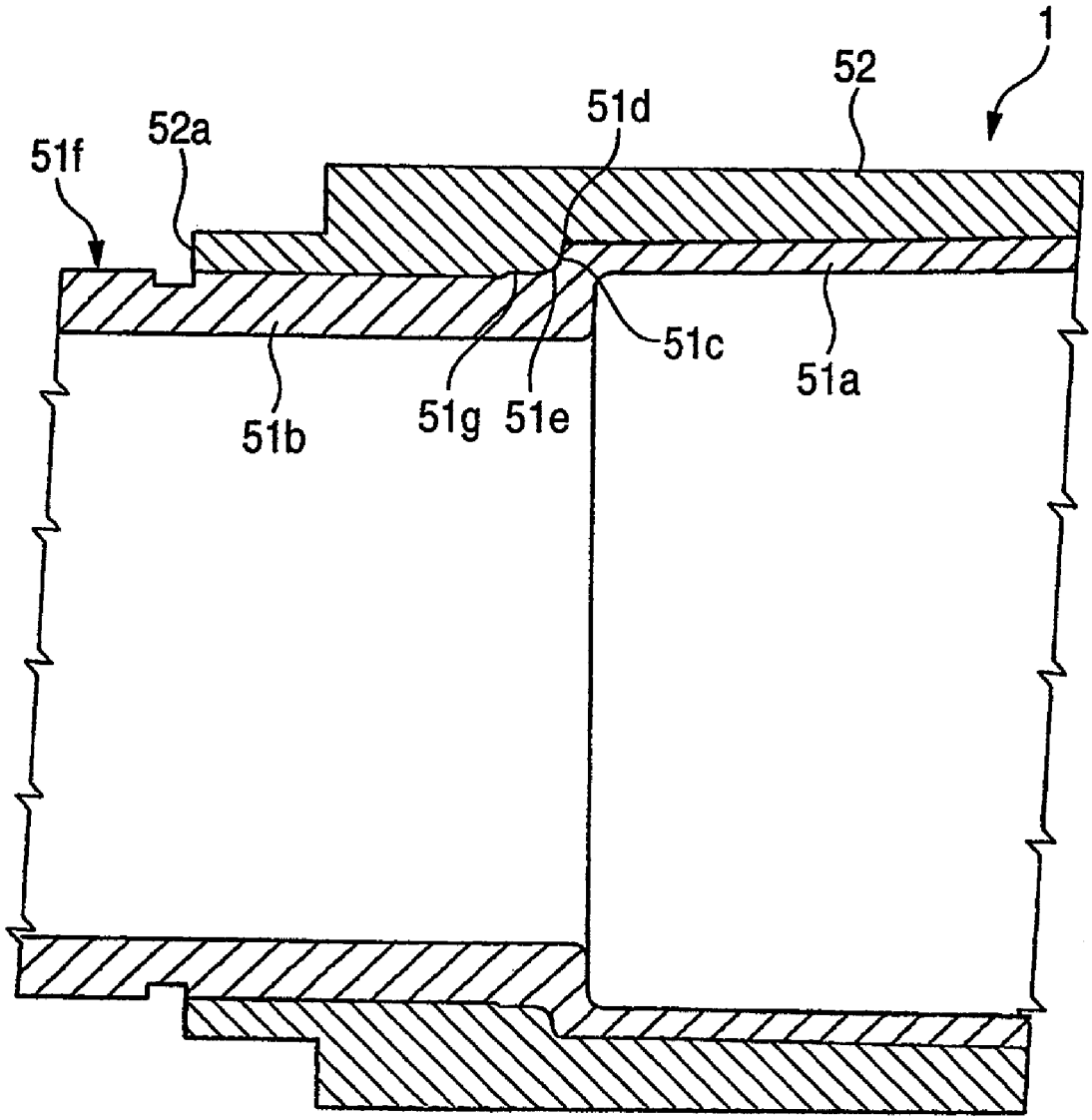
FIG. 12 is an enlarged sectional view of part of a heating roller shown in FIG. 10.
Figure 13:
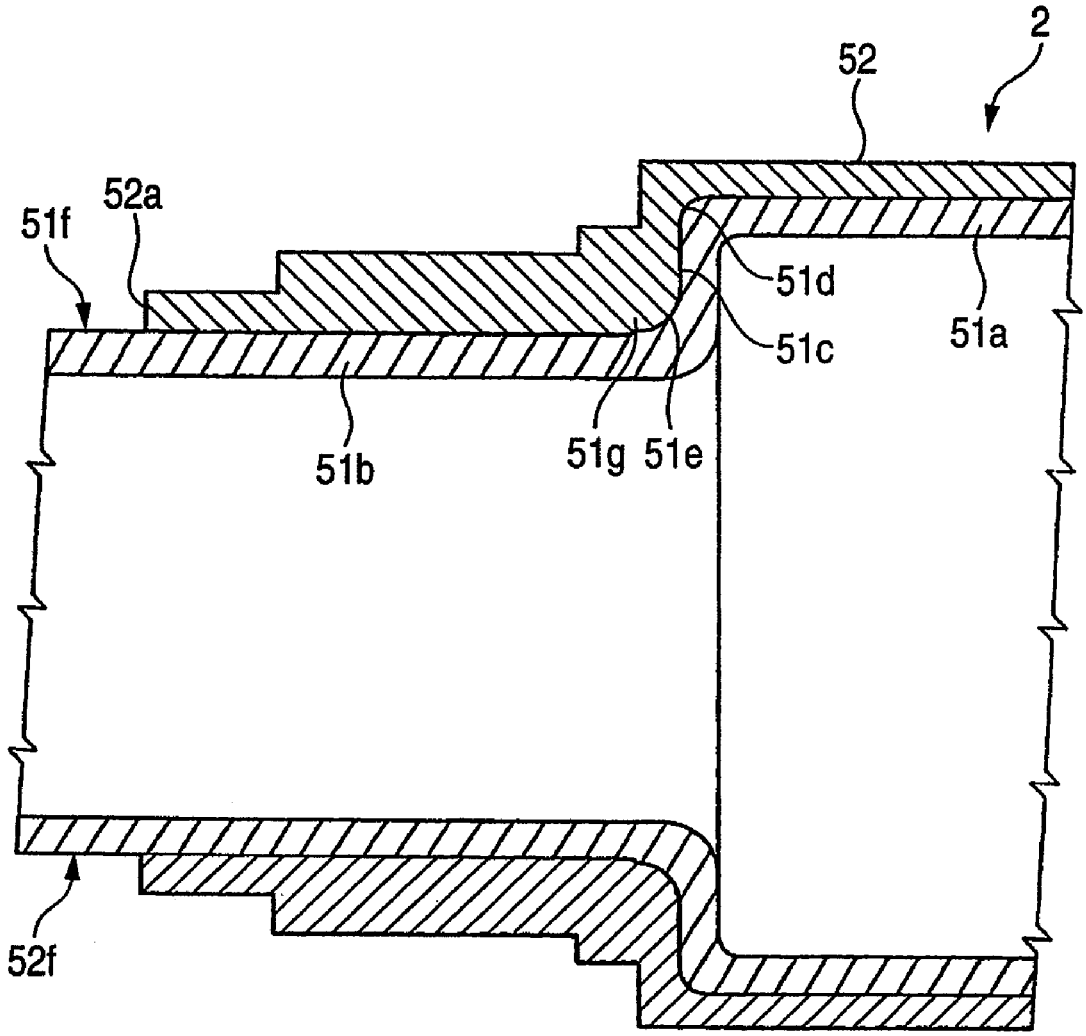
FIG. 13 is an enlarged sectional view of part of a pressure roller shown in FIG. 10.

As shown in FIGS. 12 and 13, an end of the rubber layer 52 is secured such that at least the portion 51*g* finished by mechanical work (described the above in detail) is covered as in the as in the present embodiment, the unstable portions are entirely covered with the rubber layer 52. Thus, the rubber layer 52 can be provided with a very simple structure at a low cost because there is no factor restricting the formation of the rubber layer.

An image forming apparatus incorporating a fixing device as described above will now be described with reference to FIG. 14. In the figure, reference numeral 10 represents an image forming apparatus.

The image forming apparatus 10 has a housing 10*a*, a sheet output tray 10*c* formed on the top of the housing 10*a*, and a door 10*b* openably mounted on a front face of the housing 10*a*. An exposure unit W, an image forming unit D, a transfer belt unit 29 including an image transporter 18, and a sheet supply unit 30 are disposed in the housing 10*a*, while a sheet conveyer unit 11 is disposed in the door 10*b*. Each of the units is configured to be attachable and detachable to and from the main body and is configured such that it can be removed as an integral body to be repaired or replaced at the time of maintenance.

The image forming unit D has image forming stations Y (for yellow), M, (for magenta), C (for cyan), and K (for black) for forming images in a plurality of colors (four colors in this embodiment). Each of the image forming stations Y, M, C, and K has an image supporter 17 constituted by a photosensitive drum, a charging unit 19 constituted by a corona charger disposed around the image supporter 17, and the developing unit 20. The image forming stations Y, M, C, and K are arranged side by side along a diagonal arched line under the transfer belt unit 29 with their image supporters 17 facing upward. The image forming stations Y, M, C, and K may be arranged in an arbitrary order.

The transfer belt unit 29 comprises: a driving roller 12 disposed in a lower part of the housing 10*a* and rotated by a driving source which is not shown; a driven roller 13 disposed diagonally above the driving roller 12; a tension roller 14; the image transporter 18 which is constituted by an intermediate transfer belt stretched between the three rollers or at least two of them and driven for circulation in the direction of the arrow in the figure; and a cleaning unit 15 which is in contact with a surface of the image transporter 18. The driven roller 13, the tension roller 14, and the image transporter 18 are disposed in a direction that is inclined to the left of the driving roller 12 in the figure. As a result, a belt surface 18*a* of the image transporter 18 to be moved in a downward direction is positioned lower, and a belt surface 18*b* of the image transporter 18 to be moved in an upward direction is positioned higher.

Therefore, the image forming stations Y, M, C, and K are also disposed in a direction that is inclined to the left of the driving roller 12 in the figure. The image supporters 17 are put in contact with the belt surface 18*a* of the image transporter 18 and rotated in the direction indicated by arrows in the figure. The image transporter 18 that is in the form of a flexible endless sleeve is put in contact with the image supporters 17 at substantially the same winding angle so as to cover them from above. Therefore, the contact pressures and nip widths between the image supporters 17 and the image transporter 18 can be adjusted by controlling the tension applied to the image transporter 18 by the tension roller 14, the intervals at which the image supporters 17 are provided, and the winding angles (the curvature of the arch).

The driving roller 12 also serves as a backup roller for a secondary transfer roller 39. For example, a rubber layer having a thickness of about 3 mm and a volume resistivity of $10^5 \Omega \cdot$cm or less is formed on a circumferential surface of the driving roller 12 and is grounded through a shaft made of metal to provide a conductive path for a secondary transfer bias supplied through the secondary transfer roller 39. By providing such a rubber layer having high friction and shock absorbing properties on the driving roller 12, any shock occurring when a sheet material enters the secondary transfer portion can be made less apt to be transmitted to the image transporter 18, and this makes it possible to prevent deterioration of image quality. By providing the driving roller 12 with a diameter smaller than those of the driven roller 13 and the tension roller 14, a sheet material which has been subjected to secondary transfer is allowed to be easily separated by an elastic force of the sheet material itself. Further, the driven roller 13 is also used as a backup roller for the cleaning unit 15 which will be described later.

The image transporter 18 may be disposed in a direction that is inclined to the right of the driving roller 12 in the figure, and the image forming stations Y, M, C, and K may be also disposed in the form of a diagonal arch in a direction that is inclined to the right of the driving roller 12, accordingly.

The cleaning unit 15 comprises: a cleaning blade 15*a* which is provided on the side of the belt surface 18*a* to remove any toner left on the surface of the image transporter 18 after the secondary transfer; and a toner conveyer 15*b* for conveying the collected toner. The cleaning blade 15*a* abuts on the image transporter 18 in the region where the image transporter 18 is wound around the driven roller 13. Primary transfer members 16 abut on the back surface of the image transporter 18 opposite to the image supporters 17 of the image forming stations Y, M, C, and K which will be described later, and a transfer bias is applied to the primary transfer members 16.

The exposure unit W is disposed in a space formed diagonally below the image forming unit D which is diagonally disposed. The sheet supply unit 30 is disposed at the bottom of the housing 10*a* under the exposure unit W. The exposure unit W as a whole is contained in a case, and the case is disposed in a space formed diagonally below the belt surface which is transported in a downward direction. A single scanner unit 21 comprising a polygon mirror motor 21*a* and a rotatable polygon mirror 21*b* is horizontally disposed at the bottom of the case. Laser beams from a plurality of laser light sources 23 modulated by image signals in respective colors are reflected at the polygon mirror 21*b* to deflect and scan them on the image supporters 17, and there is disposed a single f-θ lens 22 and a plurality of reflecting mirrors 24 for folding the paths of the scanning beams in the respective colors toward the image supporters in non-parallel with each other.

In the exposure unit W having the above-described configuration, image signals associated with respective colors exit the polygon mirror 21*b* in the form of laser beams modulated and formed based on a common data clock frequency, and the laser beams travel through the f-θ lens 22 and the reflecting mirror 24 and impinge upon the image supporters 17 of the image forming stations Y, M, C, and K to form latent images. The paths of the scanning beams are deflected by providing the reflecting mirror 24, which makes it possible to reduce the height of the case and to thereby make the optical system compact. In addition, the reflecting mirror 24 is provided to equalize the scanning optical path lengths up to the image supporters of the image forming stations Y, M, C, and K.

In such a configuration, the scanning widths of the optical beams scanned through the respective optical paths are substantially the same, which eliminates a need for any special configuration for the formation of image signals.

Therefore, the laser light sources can be modulated based on a common data clock frequency, although they are modulated by different image signals in association with images in different colors. Since a common reflecting surface is used, color deviations attributable to relative differences in the sub-scanning direction. It is therefore possible to configure a color image forming apparatus having a simple structure at a low cost.

The scanning optical system is provided in a lower part of the apparatus, which makes it possible to minimize vibration of the scanning optical system due to vibration imparted to the frame supporting the apparatus from the driving system of the image forming unit, thereby preventing any deterioration in image quality. In particular, by providing the scanner unit 21 at the bottom of the case, vibration imparted to the case as a whole by the polygon motor 21*a* itself can be minimized to prevent any deterioration in image quality. Further, vibration imparted to the case as a whole can be minimized by providing only one polygon motor 21*a* that is a source of vibration.

The sheet supply unit 30 has a sheet supply cassette 35 and a pickup roller 36 for feeding sheet materials from the sheet supply cassette 35 one sheet at a time. The sheet conveyer unit 11 comprises: a pair of gate rollers 37 (one of the rollers is provided on the housing 10*a*) for regulating timing at which the sheet materials are supplied to the secondary transfer portion; the secondary transfer roller 39 which is pressed against the driving roller 12 and the image transporter 18; a main transport path 38; a fixing unit 50; a pair of sheet ejection rollers 41; and a transport path 42 for double-side printing.

A secondary image (unfixed toner image) formed on a sheet material as a result of secondary transfer is fixed at a predetermined temperature in a nip portion formed by the fixing unit 50. The fixing unit 50 can be disposed in a space formed diagonally above the upwardly transported belt surface 18*b* of the image transporter 18. In other words, a space on the side of the transfer belt opposite to the image forming stations, which makes it possible to reduce heat transmission to the exposure unit W, the image transporter 18, and the image forming unit D and to reduce the frequency of color deviation correcting operations for each color. In particular, the exposure unit W is positioned furthest from the fixing unit 50, and displacement of components of the scanning optical system of the same attributable to heat can be minimized to prevent color deviation.

Figure 14:
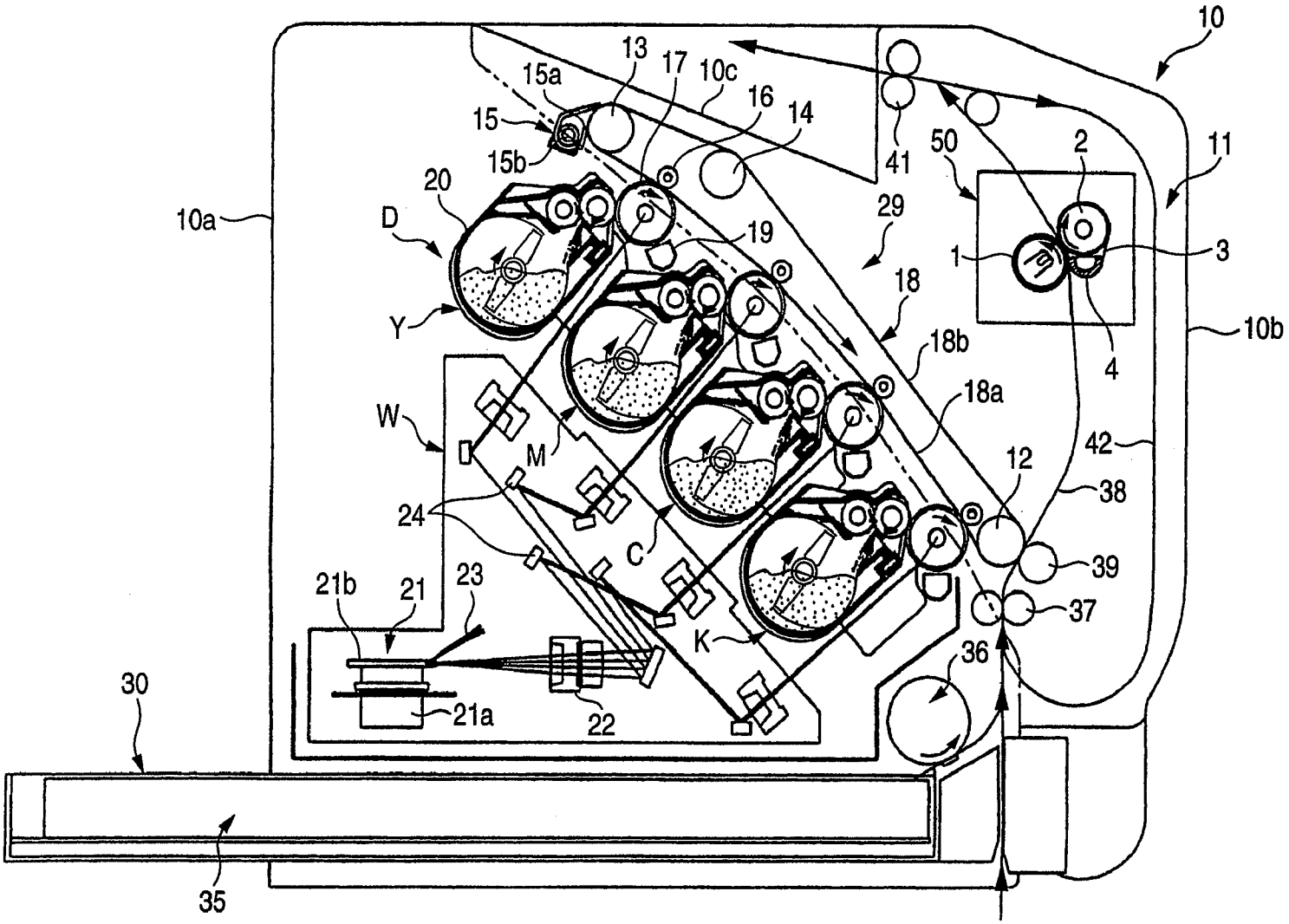
FIG. 14 is a schematic sectional view showing an image forming apparatus incorporating the fixing device of the invention.

Since the image transporter 18 is disposed in a direction that is inclined relative to the driving roller 12, a large space is left in a position on the right side of FIG. 14, and the fixing unit 50 can be disposed in that space. It is therefore possible to downsize the apparatus and to prevent heat generated by the fixing unit 50 from being transmitted to the exposure unit W, the image transporter 18, and the image forming stations Y, M, C, and K which are located on the left side. Further, since the exposure unit W can be disposed in a space located below and to the left of the image forming unit D, it is possible to minimize vibration of the scanning optical system of the exposure unit W attributable to vibration of the housing 10*a* imparted by the driving system of the image forming unit and to thereby prevent any deterioration in image quality.

Since no cleaning unit for the charging unit 19 is provided, the corona charger is employed. In a case where the charger is provided as a roller member, toner remains on the image supporters 17 after the primary transfer although in a very small amount, and it accumulates on the roller to cause a charging failure. Toner is less apt to stick to the corona charger which is a non-contact type charger, and the occurrence of a charging failure can therefore be prevented.

This apparatus employs a configuration in which an intermediate transfer belt is used as the image transporter 18 which is put in contact with the image supporters 17. Alternatively, a configuration may be employed in which a belt conveying a sheet material is used as the image transporter 18 which is put in contact with the image supporters 17. In this case, toner images are sequentially transferred on a sheet material adhered on the belt member in a superposed manner. Incidentally, the circulating direction of the belt member is upward at a lower surface thereof that is in contact with the image supporters 17.

Briefly, operations of the above-described image forming apparatus are as follows.

When a print command signal (image formation signal) from a host computer (such as a personal computer) which is not shown is input to a control unit of the image forming apparatus 10, the image supporters 17 of the image forming stations Y, M, C, and K, the rollers of the development unit 20, and the image transporter 18 are rotated.

The outer circumferential surfaces of the image supporters 17 are uniformly charged by the charging units 19.

The outer circumferential surfaces of the uniformly charged image supporters 17 of the image forming stations Y, M, C, and K are selectively exposed the exposure unit W according to image information for each color to form a electrostatic latent image in each color.

A toner image is developed by the development unit 20 from the electrostatic latent image formed on each image supporter 17.

A primary transfer voltage having the polarity opposite to the charging polarity of toner is applied to the primary transfer members 16. At the primary transfer position, the toner images formed on the image supporters 17 are sequentially transferred (superposed) on to the image transporter 18 as the image transporter 18 moves.

In synchronism with the movement of the image transporter 18 which has been subjected to primary transfer of the primary images, a sheet material contained in the sheet supply cassette 35 is fed to the secondary transfer roller 39 via the pair of gate rollers 37.

The primary transfer images meet the sheet material in synchronism with the same at the secondary transfer position, and a bias of the reverse polarity is applied to the primary transfer images by the secondary transfer roller 39 which is pressed against the driving roller 12 by a pressing mechanism which is not shown. Thus, the primary transfer images formed on the image transporter 18 are subjected to secondary transfer on to the sheet material which has been synchronously fed.

Toner which remains after the secondary transfer is transported toward the driven roller 13 and scraped off by the cleaning unit 15 provided opposite to the roller 13, and the image transporter 18 is refreshed to enable the repetition of the above-described cycle.

The toner image on the sheet material is fixed when the sheet material passes through the fixing unit 50, and the sheet material is then transported to a predetermined position (the sheet ejection tray 10*c* when double-side printing is not performed, and the transport path 42 for double-side printing when double-side printing is performed).

The fixing rubber roller of the invention is not limited to a case where it is incorporated in the above described image forming apparatus, but it may be incorporated in any well-known image forming apparatus.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A device for fixing a toner image on a recording medium, comprising:

a first roller, comprising:

a heat source;

a rotatable, cylindrical first core member;

a first elastic member, rotatable together with the first core member;

a first rubber layer, secured to an outer periphery of the first core member; and a second roller, comprising:

a rotatable, cylindrical second core member;

a second elastic member, rotatable together with the second core member; and a second rubber layer, secured to an outer periphery of the second core member, and brought into contact with the first rubber layer to form a nip portion therebetween through which the recording medium is passed, and such that one of the first roller and the second roller is rotated by the rotation of the other;

wherein the first elastic member and the second elastic member are brought into contact with each other at a position other than the nip portion;

the first elastic member has a hardness which is lower than a hardness of the first rubber layer; and the second elastic member has a hardness which is lower than a hardness of the second rubber layer.

2. The fixing device as set forth in claim 1, further comprising:

a first support member, which rotatably supports the first roller; and a second support member, which rotatably supports the second roller, wherein:

the first elastic member is arranged closer to a longitudinal end of the first roller than the first support member; and the second elastic member is arranged closer to a longitudinal end of the second roller than the second support member.

3. The fixing device as set forth in claim 2, wherein:

the first support member and the first elastic member are provided at each of longitudinal ends of the first roller; and the second support member and the second elastic member are provided at each of longitudinal ends of the second roller.

4. An image forming apparatus for forming a toner image on a recording medium, the apparatus comprising the device for fixing the toner image on the recording medium, as set forth in claim 1.

5. A device for fixing a toner image on a recording medium, comprising:

a first roller, comprising:

a heat source;

a rotatable, cylindrical first core member;

a first elastic member, rotatable together with the first core member;

a first rubber layer, secured to an outer periphery of the first core member; and a heat-resistant belt member, stretched by a second roller and a stretcher and circulated therearound, the second roller, comprising:

a rotatable, cylindrical second core member;

a second elastic member, rotatable together with the second core member; and a second rubber layer, secured to an outer periphery of the second core member, wherein:

the belt member is brought into contact with the first rubber layer to form a nip portion therebetween through which the recording medium is passed;

the first elastic member and the second elastic member are brought into contact with each other at a position other than the nip portion;

the first elastic member has a hardness which is lower than a hardness of the first rubber layer; and the second elastic member has a hardness which is lower than a hardness of the second rubber layer.

6. The fixing device as set forth in claim 5, further comprising:

a first support member, which rotatably supports the first roller; and a second support member, which rotatably supports the second roller, wherein:

the first elastic member is arranged closer to a longitudinal end of the first roller than the first support member; and the second elastic member is arranged closer to a longitudinal end of the second roller than the second support member.

7. The fixing device as set forth in claim 6, wherein:

the first support member and the first elastic member are provided at each of longitudinal ends of the first roller; and the second support member and the second elastic member are provided at each of longitudinal ends of the second roller.

8. An image forming apparatus for forming a toner image on a recording medium, the apparatus comprising the device for fixing the toner image on the recording medium, as set forth in claim 5.

* * * * *